US005686822A

United States Patent [19]

Croft et al.

[11] Patent Number: 5,686,822

[45] Date of Patent: Nov. 11, 1997

[54] METHOD OF MAKING A REFERENCE CURRENT GENERATOR

[75] Inventors: Gregg Douglas Croft, Palm Bay, Fla.; Sang-Gug Lee, Kyungbook, Rep. of Korea; Steven Robert Jost, Palm Bay, Fla.

[73] Assignee: Harris Corporation, Melbourne, Fla.

[21] Appl. No.: 640,108

[22] Filed: Apr. 30, 1996

[51] Int. Cl.[6] ..... G05F 1/10

[52] U.S. Cl. ..... 323/312

[58] Field of Search ..... 327/538, 540, 327/541, 543, 545, 546, 437, 78, 77, 334; 323/315, 312

[56] References Cited

U.S. PATENT DOCUMENTS 5,563,549 10/1996 Shieh ..... 327/543

*Primary Examiner*—Aditya Krishnan
*Attorney, Agent, or Firm*—Rogers & Killeen

[57] ABSTRACT

A current generator and method of making a current generator in which two resistors are provided, each in series with one of two transistors in the generator, and in which one of the resistors is trimmed if the reference current is too large and the other is trimmed if the reference current is too small, thereby obviating the problems of the prior art in which one resistor must be trimmed by a potentially large and unacceptable amount. The two resistors are formed with a distribution of resistances which is centered on their corresponding target resistance values so that the number of resistors to be trimmed and the amount of trimming per resistor are reduced. The appropriate target resistances of the resistors can be determined if a maximum trim factor is set. The method is insensitive to variations in the process by which the resistances of the resistors are initially set and reduces the variability of the untrimmed reference current with respect to resistor critical dimensions.

15 Claims, 1 Drawing Sheet

METHOD OF MAKING A REFERENCE CURRENT GENERATOR

BACKGROUND OF THE INVENTION

The present invention relates to current generators, and more particularly to a method of making resistors for a reference current generator which is generally insensitive to variations in the process by which the resistances of the resistors in the current generator are initially set.

A current generator produces a target current of predetermined amperage which falls within a range of acceptable values. The current is desirably insensitive to supply voltage variations. A conventional reference current generator is illustrated in FIG. 1 (a "kT/qR" circuit) in which the reference current, I, may be determined from:

$$I=\frac{V_t\ln\left(\frac{A1}{A2}\right)}{R1} \tag{1}$$

where Vt is the thermal voltage kT/q (about 26 mV at room temperature), and A1 and A2 are the emitter areas of transistors Q1 and Q2, respectively, (the emitter areas of transistors Q3 and Q4 being equal), R1 is the resistance of resistor R1 in ohms, and the base currents are assumed to be negligible.

The accuracy of the reference current is of obvious importance and thus the ability to correct the reference current provided by the reference current generator if I is not the target value when the current generator is initially assembled is an important characteristic. To this end, it is known to use a NiCr resistor for resistor R1 in FIG. 1 and to trim the NiCr resistor until the target reference current is achieved. Various resistor trimming methods are known, such as laser trimming.

However, this solution is not without difficulties because the trimming introduces further problems. As is known, the process for initially forming the resistors has unavoidable variations which cause the resistance of the resistor to vary from a target resistance. For example, a conventional resistor manufacturing process provides resistors which have a distribution of resistances which may vary by as much as 30% above or below the target resistance. Trimming can only increase the resistance of the resistor (trimming reduces resistor width, thereby increasing resistance,) and therefore the initially formed resistor should be wider than needed. Because it is desirable to be able to have all of the resistors within this distribution achieve the target value to avoid waste, the initial resistance of the untrimmed, initially formed, resistor should be set so that it is at least 30% below the target value that is desirably achieved after trimming thereby providing an untrimmed distribution of −60% to 0% (continuing with the example of 30% variation.) Thus, the center of the distribution of resistances of the initially formed resistors is skewed toward low resistance (e.g., 30% below the target resistance) creating a large area which is potentially wasted. Further, because the distribution is skewed from the target value, it is likely that most, if not all, of the resistors would require some trimming, thereby increasing manufacturing costs.

The prior art process may also produce resistors which have to be trimmed by more than 50% of their width, such as the resistors at the −60% end of the distribution. Such large trimming would likely violate recognized quality control standards (e.g., trim visual inspection criteria require less than 50% width trimming.)

Another problem of the prior art is that the procedures for trimming do not provide a method of determining the appropriate target resistances of the resistors if a maximum trim factor has been established. For example, it may be desirable to limit the amount a resistor can be trimmed so that its resistance increases by no more than, say 20%. The benefits of limiting the trim factor include less wasted chip area, improved manufacturability and increased reliability.

Accordingly, it is an object of the present invention to provide a novel method of making a current generator which obviates the problems of the prior art.

It is another object of the present invention to provide a novel method of making a current generator in which the resistors therein are formed with a size distribution which is centered on their corresponding target resistance values so that the number of resistors to be trimmed and the amount of trimming per resistor are reduced.

It is yet another object of the present invention to provide a novel method of determining the appropriate target resistances of the resistors in a current generator in which a maximum trim factor has been established.

It is still another object of the present invention to provide a novel method of making resistors for a reference current generator which is insensitive to variations in the process by which the resistances of the resistors are initially set.

It is a further object of the present invention to provide a novel reference current generator and method of manufacture in which two resistors are provided, each in series with one of two transistors in the generator, and in which one of the resistors is trimmed by an acceptable amount if the reference current is too large and the other is trimmed by an acceptable amount if the reference current is too small, thereby obviating the problems associated with providing one resistor which must be trimmed by a potentially large and unacceptable amount.

It is yet a further advantage of the present invention to provide a novel method of making a resistor for a current generator which reduces the variability of the untrimmed reference current with respect to resistor critical dimensions.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
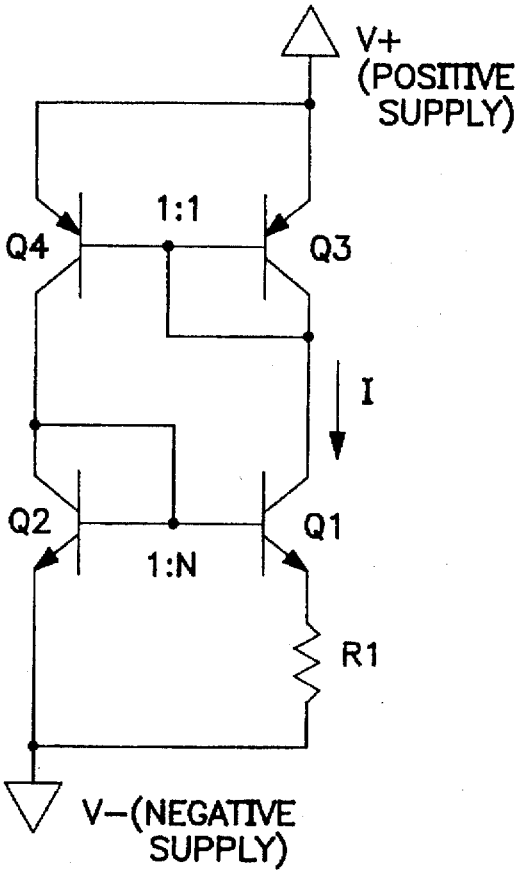
FIG. 1 PRIOR ART
FIG. 1 is a partial circuit diagram of a reference current generator of the prior art.
Figure 2:
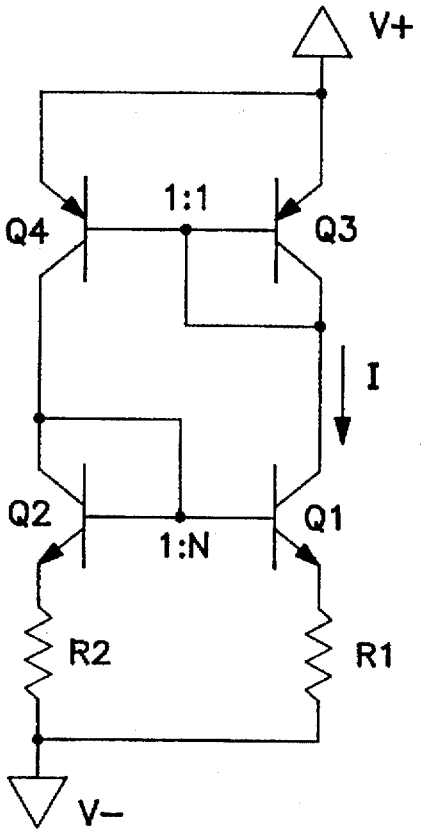
FIG. 2 is a partial circuit diagram of an embodiment of a reference current generator of the present invention.

With reference now to FIG. 2 which is a circuit of the present invention for providing a reference current I within a target range (as set by the accuracy requirements for the generator), resistor R2 has been added to the circuit of FIG. 1 in series between transistor Q2 and a DC potential, such as ground. In the new circuit, reference current I may be determined from:

$$I=\frac{V_t\ln\left(\frac{A1}{A2}\right)}{(R1-R2)} \tag{2}$$

where R1>R2 and A3=A4 and again assuming that the base currents are negligible. The ratio of the emitter areas of Q1 to Q2 may be N. Significantly, reference current I may be increased by trimming (increasing the resistance of) resistor R2 or may be decreased by trimming resistor R1.

In an embodiment of the method of the present invention practiced with the circuit of FIG. 2 resistors R1 and R2 are initially formed at approximately their respective target resistance values by a conventional process which tolerates variation in resistances of the two resistors (e.g., plus or minus 30% from a target resistance.) Reference current I is thereafter measured at a location such as indicated by the current arrow in FIG. 2. In the event the measured reference current exceeds the target range, resistor R1 may be trimmed by a small amount. In the event the measured reference current is less than the target range, resistor R2 may be trimmed by a small amount. The steps of measuring reference current and trimming may be repeated until the reference current is within the target range. The amount to be trimmed may be determined by routine engineering. The trimming process may be conventional.

This process affords a method of making a current generator, and of making the resistors therein, which is generally insensitive to the process by which the resistances of the resistors are initially set. The reference current can be corrected up or down by selection of which resistor to trim, in contrast to the prior art which could only correct the reference current if it was too high. Correction up or down affords an enhanced ability to correct for deviations from the target reference current arising from variation in resistor sheet resistance and other less significant sources of error.

The method of the present invention provides a current generator in which the resistors therein are formed with a distribution of resistances which is centered on their corresponding target resistance values so that the number of resistors to be trimmed and the amount of trimming per resistor are reduced. This advantage is available because the reference current can be corrected up or down by trimming an appropriate one of the two resistors. When the resistance distribution of the initially formed resistors is centered on the corresponding target resistance values (e.g., a distribution of plus or minus 30% from the target value), rather than on a center skewed toward lower resistance as in the prior art, more of the resistors will tend to be close to the target value (e.g., within the target range) thereby increasing the number of resistors which may not have to be trimmed at all. This translates to less manufacturing time and fewer tests. Further, because the maximum size of the initially formed resistors is smaller, there is less wasted chip area. The long term stability of the resistors is also improved because the maximum amount to be trimmed is less (e.g., 30% instead of 60% in the example.) Resistors with lower percentage trims have less current flowing through the heat affected zone and improved long term stability.

Another advantage of the present invention is that it provides a method of determining the appropriate target resistances of the resistors when a maximum trim factor has been established. If, for example, a maximum trim factor of 20% is desired, it is possible to determine the appropriate target resistances for resistors R1 and R2 so that the reference current can be trimmed to the target range without exceeding the trim factor. This allows a user to customize a current generator design for post-trim stability.

The target resistance for resistor R2 may be determined from the larger of:

$$R2=\frac{R(\mathrm{H}-1)}{H(T-1)} \text{ or, } R2=\frac{R(1-LT)}{L(T-1)} \tag{3}$$

where: R=(R1–R2), the predetermined target difference between resistances of R1 and R2 in ohms, H is the maximum variation in resistance of the resistors above a target resistance in the resistor manufacturing process expressed as a multiplier (for +30% variation, H=1.3), L is the maximum variation in resistance of the resistors below the target resistance in the resistor manufacturing process expressed as a multiplier (for −30% variation, L=0.7), and T is the trim factor expressed as multiplier (for increasing the resistance of a resistor by 20%, T=1.2). Since R=(R1–R2), the target resistance of R1 may be determined from R1=R+R2.

Yet a further advantage afforded by the present invention is a reduction in the variability of the untrimmed reference current with respect to resistor critical dimensions. The optimum widths for resistors R1 and R2 are related by the ratio of resistor values, such that W2=W1(R2/R1), where Wx is the width of a respective resistor. These resistor widths will minimize the variation of R1–R2 as resistor critical dimensions are changed. Recall from Equation (2) that R1–R2 is a factor in determining reference current. Further, when the resistor widths are set correctly, the absolute error in the resistance due to critical dimension variation is multiplied by a very small factor, a factor which is essentially the amount of critical dimension change in microns divided by resistor R1 width.

For example, if we allow R1 and R2 to be ideal values of resistors R1 and R2, and R1' and R2' to be the values of resistors R1 and R2 after critical dimension (CD) variation, the error in R1–R2 due to CD variation may be expressed (where Lx, Wx are lengths and widths of respective resistors and where ρ is resistance in ohms/square):

$$\begin{aligned}\text{Error} &= (R1-R2)-(R1'-R2')=R1-R1'-R2+R2' \\ &= \rho\frac{L1}{W1}-\rho\frac{L1}{W1+CD}-\rho\frac{L2}{W2}+\rho\frac{L2}{W2+CD} \\ &= R1\left(\frac{CD}{W1+CD}\right)-R2\left(\frac{CD}{W2+CD}\right)\end{aligned} \tag{4}$$

If we set the error equal to zero and solve for W2 we get:

$$W2=\frac{R2}{R1}\,W1+CD\left(\frac{R2}{R1}-1\right) \tag{5}$$

Now if the error is recalculated with (R2·W1)/R1 substituted for W2 we get:

$$\text{Error}=\frac{R1\,CD^2\left(\frac{R1}{R2}-1\right)}{W1^2+CDW1\left(1+\frac{R1}{R2}\right)-\frac{R1}{R2}\,CD^2} \tag{6}$$

Similar calculations for the prior art of FIG. 1 reveals that the error in R1 due to CD variation in the prior art is:

$$\text{Error}=R1\left(\frac{CD}{W1+CD}\right) \tag{7}$$

As will be apparent from the table below, the errors due to CD variation are significantly less in the present invention (the right hand side of the table) when compared to the prior art (the left hand side of the table). In each example below, the CD is 0.1 microns. (ERR OHMS is the error in R1 (prior art) or R1–R2 (present invention) in ohms and % ERR is ERR OHMS divided by the target value of R1 or R1–R2.)

TABLE 1

| FIG. 1 (Equation 7) | | | | FIG. 2 (Equation 6) | | | | | |
|---|---|---|---|---|---|---|---|---|---|
| R1 | W1 | ERR OHMS | % ERR | R1 | W1 | R2 | W2 | ERR OHMS | % ERR |
| 2K | 8 | 24.7 | 1.2 | 4K | 16 | 2K | 8 | 0.2 | .01 |
| 1K | 8 | 12.3 | 1.2 | 2K | 16 | 1K | 8 | 0.1 | .01 |
| 100 | 8 | 1.2 | 1.2 | 200 | 16 | 100 | 8 | 0.0 | .01 |
| 2K | 40 | 5.0 | 0.2 | 4K | 16 | 2K | 8 | 0.2 | .01 |
| 1K | 40 | 2.5 | 0.2 | 2K | 16 | 1K | 8 | 0.1 | .01 |
| 100 | 40 | 0.2 | 0.2 | 200 | 16 | 100 | 8 | 0.0 | .01 |
| 2K | 1.2K | 0.2 | 0.01 | 4K | 16 | 2K | 8 | 0.2 | .01 |
| 1K | 1.2K | 0.1 | 0.01 | 2K | 16 | 1K | 8 | 0.1 | .01 |
| 100 | 1.2K | 0.0 | 0.01 | 200 | 16 | 100 | 8 | 0.0 | .01 |

Figure 3:
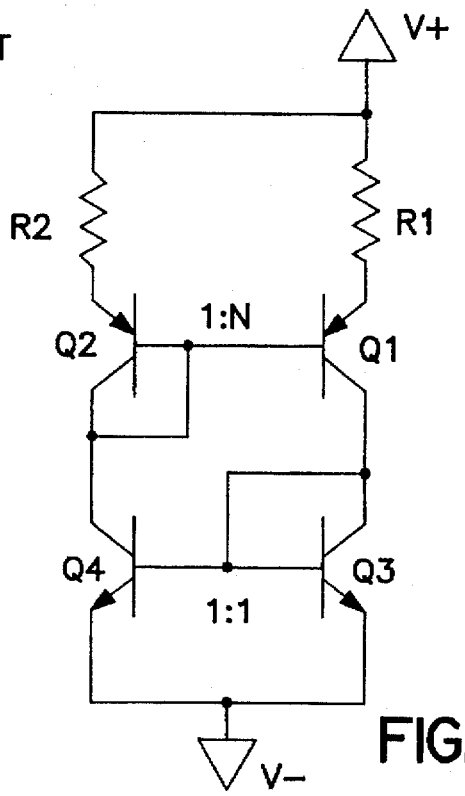
FIG. 3 is a partial circuit diagram of a further embodiment of reference current generator of the present invention.

In an alternative embodiment, resistors R1 and R2 may be connected between the transistors Q1 and Q2 to a positive DC potential, such as illustrated in FIG. 3.

As will be appreciated, the present invention finds application in current generators of various types, and while it is envisioned that a significant use of the method will be in reference current generators, the invention is not so limited.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of making a current generator for providing a reference current which is within a target range, the current generator having two pairs of transistors connected to provide the reference current and two trimmable resistors, a first of the resistors being connected in series between a DC potential and a first transistor of a first of the two pairs, and a second of the resistors being connected in series between the DC potential and a second transistor of the first pair comprising the steps of:

(a) initially forming the two resistors for the current generator at approximately their respective target resistance values by a process which tolerates variation in resistances thereof;

(b) measuring the reference current;

(c) in the event the measured reference current exceeds the target range, trimming the first resistor;

(d) in the event the measured reference current is less than the target range, trimming the second resistor; and (e) repeating steps (b)–(d) until the reference current is within the target range whereby the resistors may be trimmed to provide a reference current which is within the target range.

2. The method of claim 1 further comprising the steps of providing a maximum trim factor, and using the maximum trim factor to determine the target resistance values of the first and second resistors, whereby in steps (b)–(d) the reference current will reach the target range without the trimming exceeding the maximum trim factor.

3. The method of claim 2 further comprising the step of providing a target difference between the resistances of the first and second resistors, and wherein the step of determining the resistances of the first and second resistors also includes using the target difference.

4. The method of claim 1 where the resistance of the second resistor is determined from the larger of:

$$R2=\frac{R(\mathrm{H}-1)}{H(T-1)} \text{ or, } R2=\frac{R(1-LT)}{L(T-1)}$$

where R is the target difference (R1–R2), H is the maximum variation in resistance of the resistors above a target resistance in the resistor manufacturing process, L is the maximum variation in resistance of the resistors below the target resistance in the resistor manufacturing process, and T is the trim factor, where H, L and T are expressed as multipliers.

5. A method of making first and second resistors for a current generator which provides a reference current within a target range, the method being generally insensitive to variations in a process for initially setting resistances of the resistors and comprising the steps of:

(a) determining a maximum trim factor which is the largest acceptable increase in resistance of the first and second resistors caused by trimming the resistors when the reference current is adjusted to be within the target range in the steps below;

(b) determining a target difference between the resistances of the first and second resistors;

(c) determining a target resistance for each of the resistors using the maximum trim factor and the target difference;

(d) initially forming the first and second resistors at approximately their respective target resistances by a process which tolerates variation in resistances of the resistors from the determined target resistances;

(e) measuring the reference current generated by the current generator;

(f) in the event the measured reference current exceeds the target range, trimming the first resistor;

(g) in the event the measured reference current is less than the target range, trimming the second resistor; and (h) repeating steps (e)–(g) until the reference current is within the target range, whereby the reference current will reach the target range while trimming no more than the maximum trim factor.

6. The method of claim 5 where the resistance of the second resistor is determined from the larger of:

$$R2=\frac{R(\mathrm{H}-1)}{H(T-1)} \text{ or, } R2=\frac{R(1-LT)}{L(T-1)}$$

where R is the target difference (R1–R2), H is the maximum variation in resistance of the resistors above the target resistance in the resistor manufacturing process, L is the maximum variation in resistance of the resistors below the target resistance in the resistor manufacturing process, and T is the trim factor, where H, L and T are expressed as multiples.

7. A method of setting resistances of resistors in a current generator comprising the steps of:

(a) setting a maximum trim factor for the resistors;

(b) determining the appropriate target resistances of each of the resistors based on the maximum trim factor;

(c) forming the resistors with a resistance distribution which is centered on the corresponding determined target resistance values, the resistors being formed in a process which tolerates variation of the resistance.

8. The method of claim 7 further comprising the steps of measuring the current generated by the current generator, and in the event the measured current exceeds a target value, trimming a first one of the resistors, and in the event the measured current is less than the target value, trimming the other of the resistors.

9. A reference current generator for providing a reference current, comprising:

two pairs of transistors, wherein said transistors in a first of said two pairs have common bases and wherein said transistors in a second of said two pairs have common bases, and wherein emitters of said transistors in said second pair are connected to a DC potential and collectors of said transistors in said second pair are each connected to a corresponding collector of one of said transistors of said first pair; and two resistors, a first of said two resistors being connected in series between the DC potential and a first transistor of said first pair, and a second of said two resistors being connected in series between the DC potential and a second transistor of said first pair.

10. The reference current generator of claim 9 wherein the DC potential is a negative supply voltage.

11. The reference current generator of claim 9 wherein the DC potential is a positive supply voltage.

12. A method of providing a constant current source within a desired range of current values for use as a reference current in one or more additional circuits, the method comprising:

a. providing two parallel current paths each having a transistor and a trimmable resistor;

b. determining the value of the reference current relative to a desired value;

c. trimming the resistor in one of the two parallel paths in the event that the value of the reference current is less than the desired value to thereby increase the value of the reference current;

d. trimming the resistor in the other one of the two parallel paths in the event that the value of the reference current is greater than the desired value to thereby decrease the value of the reference current, whereby a constant current within a desired range of current values is produced.

13. The method of claim 12 wherein each of the two current paths includes a second transistor;

wherein the ratio of the emitter areas of one of the transistors in each path is approximately unity; and wherein the ratio of the emitter areas of the other of the transistors in each path is other than unity.

14. A source of a constant value reference current within a desired range of current values comprising:

two parallel current paths each having a transistor and a trimmable resistor;

means for trimming the resistor in one of the two parallel paths in the event that the value of the reference current is less than the desired value to thereby increase the value of the reference current; and means for trimming the resistor in the other one of the two parallel paths in the event that the value of the reference current is greater than the desired value to thereby decrease the value of the reference current, whereby a constant reference current within a desired range of current values is produced.

15. A reference current source comprising:

a first current path including a first resistor and first and third bipolar transistors in series between two voltages;

a second current path including a second resistor and second and fourth bipolar transistors in series between the same two voltages, the base and collector electrodes of said second and third transistors being common, the ratio of the emitter areas of said third and fourth transistors being approximately one, and the ratio of the emitter areas of said first and third transistors is other than one.

* * * * *